US005913096A

United States Patent [19]

Park

[11] Patent Number: 5,913,096

[45] Date of Patent: Jun. 15, 1999

[54] ALIGNMENT DEVICE FOR DEVELOPING ROLLER AND SQUEEGEE ROLLER OF IMAGE FORMING APPARATUS

[75] Inventor: Moon-bae Park, Suwon, Rep. of Korea

[73] Assignee: Samsung Electronics Co., Ltd., Kyungki-do, Rep. of Korea

[21] Appl. No.: 09/116,240

[22] Filed: Jul. 16, 1998

[30] Foreign Application Priority Data

Aug. 26, 1997 [KR] Rep. of Korea ..... 97-41193

[51] Int. Cl.[6] ..... G03G 15/10

[52] U.S. Cl. ..... 399/237; 399/249

[58] Field of Search ..... 399/237, 239, 399/249, 162

[56] References Cited

U.S. PATENT DOCUMENTS

| | | | |
|---|---|---|---|
| 3,368,526 | 2/1968 | Matsumoto et al. | 399/249 X |
| 3,830,199 | 8/1974 | Saito et al. | 399/239 |
| 4,127,082 | 11/1978 | Kawabata | 399/239 |
| 5,604,570 | 2/1997 | Jeran et al. | 399/162 X |
| 5,713,068 | 1/1998 | Teschendorf et al. | 399/249 |

*Primary Examiner*—Joan Pendegrass
*Assistant Examiner*—Sophia S. Chen
*Attorney, Agent, or Firm*—Sughrue, Mion, Zinn, Macpeak & Seas, PLLC

[57] ABSTRACT

An alignment device for a developing roller and a squeegee roller of an image forming apparatus. The alignment device includes a first supporting block for supporting the shaft of a first backup roller which in turn is disposed opposite to the squeegee roller with a photosensitive belt therebetween; and a second supporting block for fixing the shaft of a developing roller and enabling development by the developing roller, and for supporting the shaft of a second backup roller which in turn is disposed opposite to the developing roller with the photosensitive belt therebetween. A roller frame is provided for fixing the shaft of the squeegee roller, and for supporting the first supporting block and the second supporting block while surrounding a portion of the second supporting block. An elastic member is installed between the first and second supporting blocks for adjusting the centers of the supporting blocks. In the above image forming apparatus, since the developing roller and a corresponding backup roller are supported by an integral, one-piece supporting block, the assembly tolerance present in a conventional block is avoided. When shafts of backup rollers are seated at grooves of the respective supporting blocks, an error in the horizontal position is compensated for by an elastic force of an elastic member installed between the supporting blocks, and the supporting blocks are precisely centered. Accordingly, there is an advantage in that a developing roller and a squeegee roller can be precisely aligned with the respective backup rollers.

3 Claims, 2 Drawing Sheets

ALIGNMENT DEVICE FOR DEVELOPING ROLLER AND SQUEEGEE ROLLER OF IMAGE FORMING APPARATUS

BACKGROUND OF THE INVENTION

1. Field of the Invention

The present invention relates to an image forming apparatus and, more particularly, to an alignment device for a developing roller and a squeegee roller of an image forming apparatus in which the developing roller and the squeegee roller can be precisely aligned with respective backup rollers.

2. Description of the Related Art

In general, an image forming apparatus which reproduces text and images on a recording medium according to transmitted image data signals is provided with a photosensitive member such as a photosensitive drum or a photosensitive belt for forming a latent electrostatic image thereon, a charging device for charging the surface of the photosensitive member, an exposure device for forming a latent electrostatic image of a predetermined pattern by illuminating the charged surface of the photosensitive member by a light beam, a developing device for developing the latent electrostatic image by applying a developing agent such as a developer liquid or a toner to the exposed latent electrostatic image, and a transfer device for transferring the developed image to a recording medium.

FIG. 1 shows a schematic diagram illustrating the structure of a conventional image forming apparatus.

Referring to FIG. 1, the image forming apparatus comprises a photosensitive belt 104 mounted about first, second and third belt rollers 101, 102 and 103 to circulate about them, a discharging device 105 for erasing any remaining charge on the photosensitive belt 104, and a charging device 106 for charging the surface of the photosensitive belt 104. Exposure devices 107, 108, 109 and 110 having respective laser scanning units (not shown) are provided for illuminating an imaging region of the charged photosensitive belt 104 to selectively erase charges in the shape of an image by respective laser beams in order to form a latent electrostatic image. Developing devices 111, 112, 113 and 114 are provided for developing the latent electrostatic image by applying developer liquid according to corresponding colors, i.e., Y (yellow), M (magenta), C (cyan) and K (black). A drying device 115 for drying developer liquid applied to the latent image, and a transfer device 116 for transferring an image developed on the photosensitive belt 104 to a recording medium 117, such as a paper sheet or a film frame, are also provided.

In this case, the developing device 111 comprises a developing roller 111*a* for applying the developer liquid to the photosensitive belt 104, a developer liquid supplying device 111*b* for supplying the developer liquid to the developing roller 111*a*, a cleaning roller 111*c* for removing the developer liquid adhering to the rear surface portion of the developing roller 111*a*, first and second squeegee rollers 111*d* and 111*e* for removing excess developer liquid from the photosensitive belt 104, first and second blades 111*f* and 111*g* for removing the developer liquid adhering to the first and second squeegee rollers 111*d* and 111*e*, and a developer liquid recovery container 111*h* for recovering the developer liquid within the apparatus. In addition, the drying device 115 is provided with a heating roller 115*h* for drying the developer liquid adhering to the photosensitive belt 104, and auxiliary rollers 115*r* and 115*s* for removing the liquid toner remaining on the heating roller 115*h*, and the transfer device 116 comprises a transfer roller 116*t* for transferring an image from the photosensitive belt 104 to the recording paper 117 by relatively rotating in contact with the first belt roller 101 with the photosensitive belt 104 interposed therebetween, and a pressure roller 116*p* for fixing the image transferred on the transfer roller 116*t* onto the recording paper 117 by relatively rotating in contact with the transfer roller 116*t* with the recording paper 117 interposed therebetween.

In the above conventional image forming apparatus, when the developing roller 111*a* and the squeegee roller 111*d* contact the photosensitive belt 104 to perform their respective functions, the developing roller 111*a* and the squeegee roller 111*d* are respectively provided with backup rollers 201 and 202 for effectively performing their functions, as shown in FIG. 2.

However, since the shafts 201*s* and 202*s* of the backup rollers 201 and 202 are supported by supporting blocks 201*b* and 202*b* respectively provided with a U-shaped groove and a V-shaped groove, and the supporting blocks 201*b* and 202*b* are respectively assembled to frames 203 and 204 of the squeegee roller 111*d* and the developing roller 111*a*, as shown in FIG. 2, it is not easy precisely to align the developing roller 111*a* and the squeegee roller 111*d* with the respective backup rollers 202 and 201 due to assembly tolerances or the like. That is, vertical alignment of the squeegee roller 111*d* with the backup roller 201, vertical alignment of the developing roller 111*a* with the backup roller 202, and the maintaining of predetermined gaps between the corresponding rollers are not easy. Accordingly, it is difficult precisely to adjust the distance between the centers of the U-shaped supporting block 201*b* and V-shaped supporting block 202*b*.

SUMMARY OF THE INVENTION

To solve the above problems, it is an object of the present invention to provide an alignment device for a developing roller and a squeegee roller of an image forming apparatus in which a developing roller and a squeegee roller can be precisely aligned with respective backup rollers.

Accordingly, to achieve the above object, there is provided a roller alignment device in an image forming apparatus. The image forming apparatus includes a photosensitive belt, a squeegee roller and a corresponding first backup roller, a developing roller and a corresponding second backup roller, with each of said rollers having a shaft. The roller alignment device comprises: a first supporting block for supporting the shaft of the first backup roller which in turn is disposed opposite to the squeegee roller with the photosensitive belt therebetween; a second supporting block for fixing the shaft of the developing roller and enabling development by the developing roller, and for supporting the shaft of the second backup roller which in turn is disposed opposite to the developing roller with the photosensitive belt therebetween; a roller frame for fixing the shaft of the squeegee roller, and for supporting the first supporting block and the second supporting block while surrounding a portion of the second supporting block; and an elastic member installed between the first and second supporting blocks for adjusting the centers of the first and second supporting blocks.

In this case, the developing roller and the second backup roller are preferably supported by an integral, one-piece supporting block.

According to the present invention, since the developing roller and the corresponding backup roller are supported by an integral, one-piece supporting block, the assembly tolerance of the conventional block is avoided. When the shafts of the backup rollers are seated at grooves of respective supporting blocks, an error in the horizontal position is compensated for by an elastic force of an elastic member installed between the supporting blocks, and the supporting blocks are precisely centered. Accordingly, there is an advantage in that the developing roller and the squeegee roller can be precisely aligned with the respective backup rollers.

BRIEF DESCRIPTION OF THE DRAWINGS

The above object and advantages of the present invention will become more apparent by describing in detail a preferred embodiment thereof with reference to the accompanying drawings, in which.

DETAILED DESCRIPTION OF THE PREFERRED EMBODIMENT

Figure 1:
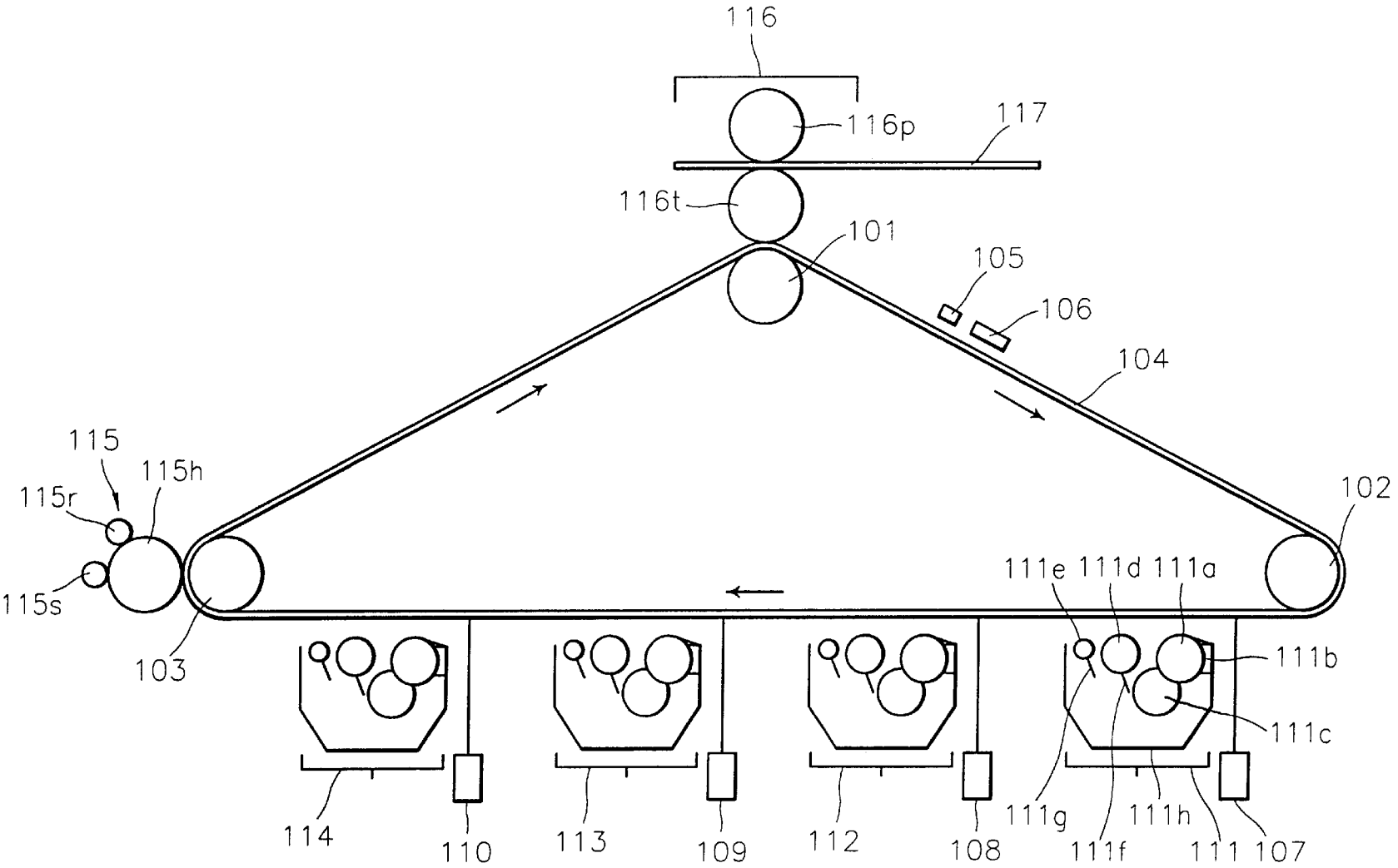
FIG. 1 is a schematic diagram illustrating a structure of a conventional image forming apparatus.
Figure 2:
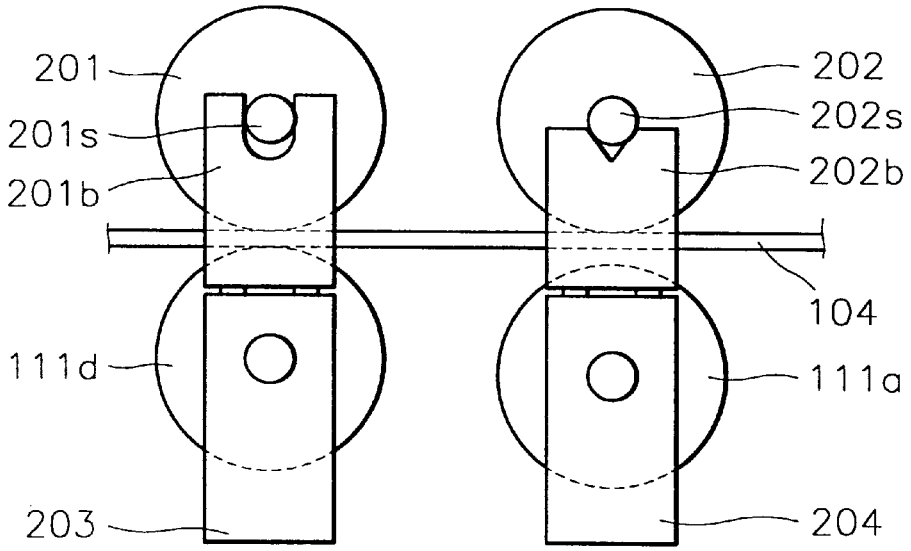
FIG. 2 (PRIOR ART)
FIG. 2 is a side view schematically illustrating alignment of a developing roller and a squeegee roller with respective backup rollers in a conventional image forming apparatus.
Figure 3:
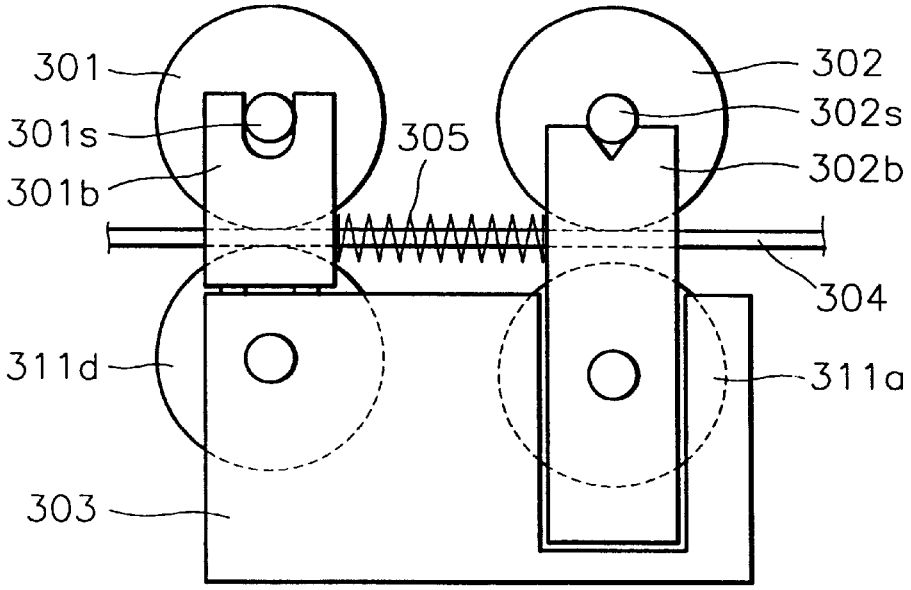
FIG. 3 is a side view schematically illustrating alignment of a developing roller and a squeegee roller with respective backup rollers in an alignment device for a developing roller and a squeegee roller of an image forming apparatus according to the present invention.

Referring to FIG. 3, in an image forming apparatus employing an alignment device for a developing roller and a squeegee roller of an image forming apparatus according to the present invention, a squeegee roller 311*d* and a developing roller 311*a* of a developing device are installed at an integral roller frame 303 having the shape shown in FIG. 3. In this case, the developing roller 311*a* is installed at the frame 303 in a state previously assembled to a second supporting block 302*b*. A first supporting block 301*b* having a U-shaped groove for supporting a first backup roller 301 corresponding to the squeegee roller 311*d* and the second supporting block 302*b* having a V-shaped groove for supporting a second backup roller 302 corresponding to the developing roller 311*a* are installed at the frame 303. In addition, an elastic member 305 is disposed between the first and second supporting blocks 301*b* and 302*b* for centering the supporting blocks 301*b* and 302*b*. In this case, a compression spring is employed as the elastic member 305. The second supporting block 302*b* is an integral, one-piece member and is manufactured to have a sufficiently long vertical dimension, as shown in FIG. 3. Accordingly, the assembly tolerance present between the developing roller frame 204 and the backup roller supporting block 202*b* in the conventional image forming apparatus is avoided.

In the above image forming apparatus according to the present invention, when the squeegee roller 311*d* and the developing roller 311*a* are aligned with the first and second backup rollers 301 and 302, that is, when the first supporting block 301*b* and the second supporting block 302*b* contact respective shafts 301*s* and 302*s* of the first and second backup rollers 301 and 302, the shafts 301*s* and 302*s* of the first and second backup rollers 301 and 302 find their way to the centers of the grooves by a buffering function of the compression spring 305. In other words, deviations in the horizontal positions of the shafts 301*s* and 302*s* of the first and second backup rollers 301 and 302 are compensated for by a buffering function of the compression spring 305, and the shafts 301*s* and 302*s* are precisely placed at respective center points of the grooves. In FIG. 3, reference numeral 304 denotes a photosensitive belt.

In the image forming apparatus described above according to the present invention, since a developing roller and a corresponding backup roller are supported by an integral, one-piece supporting block, the assembly tolerance of a conventional block is avoided. When shafts of backup rollers are seated at grooves of respective supporting blocks, an error in the horizontal position is compensated for by an elastic force of an elastic member installed between the supporting blocks, and the supporting blocks are precisely centered. Accordingly, there is an advantage in that a developing roller and a squeegee roller can be precisely aligned with respective backup rollers.

It is contemplated that numerous modifications may be made to the alignment device for developing roller and squeegee roller of the present invention without departing from the spirit and scope of the invention as defined in the following claims.

What is claimed is:

1. A roller alignment device in an image forming apparatus, the image forming apparatus including a photosensitive belt, a squeegee roller and a corresponding first backup roller, a developing roller and a corresponding second backup roller, with each of said rollers having a shaft, said roller alignment device comprising:

a first supporting block for supporting the shaft of the first backup roller which in turn is disposed opposite to the squeegee roller with the photosensitive belt therebetween;

a second supporting block for fixing the shaft of the developing roller and enabling development by the developing roller, and for supporting the shaft of the second backup roller which in turn is disposed opposite to the developing roller with the photosensitive belt therebetween;

a roller frame for fixing the shaft of the squeegee roller, and for supporting said first supporting block and said second supporting block while surrounding a portion of said second supporting block; and an elastic member installed between said first and second supporting blocks for adjusting the centers of said first and second supporting blocks.

2. The roller alignment device as claimed in claim 1, wherein said second supporting block comprises an integral, one-piece supporting block, and wherein the developing roller and the second backup roller are supported by said integral, one-piece supporting block.

3. The roller alignment device as claimed in claim 1, wherein said elastic member comprises a compression spring.

* * * * *